United States Patent [19]

Prasad

[11] Patent Number: 4,968,362

[45] Date of Patent: Nov. 6, 1990

[54] DARK METALLIC PRODUCT

[75] Inventor: Janniah S. Prasad, Norwalk, Conn.

[73] Assignee: American Cyanamid Company, Stamford, Conn.

[21] Appl. No.: 220,883

[22] Filed: Jun. 22, 1988

Related U.S. Application Data

[63] Continuation of Ser. No. 916,598, Oct. 8, 1986, abandoned.

[51] Int. Cl.[5] ..... C23C 8/14

[52] U.S. Cl. ..... 148/286; 148/287; 606/222

[58] Field of Search ..... 148/286, 287

[56] References Cited

U.S. PATENT DOCUMENTS

| | | | |
|---|---|---|---|
| 1,549,022 | 8/1925 | Otte | 148/6.14 R |
| 2,915,420 | 12/1959 | Hardy | 148/6.14 R |
| 3,437,532 | 4/1969 | Helgezt | 148/6.14 R |
| 3,920,486 | 11/1915 | Howell | 148/6.14 R |
| 4,026,737 | 5/1977 | Takahari | 148/6.14 R |

FOREIGN PATENT DOCUMENTS

| | | | |
|---|---|---|---|
| 0168833 | 1/1986 | European Pat. Off. . | |
| 0023882 | 2/1904 | Japan | 148/6.14 R |
| 37-8808 | 7/1962 | Japan | 148/6.14 R |
| 1159370 | 3/1964 | U.S.S.R. | 148/6.14 R |

*Primary Examiner*—Sam Silverberg

*Attorney, Agent, or Firm*—David A. Warmbold; Charles F. Costello, Jr.

[57] ABSTRACT

A metallic product having a dark, nonreflective and nonflaking surface is disclosed. A method of manufacturing the dark, nonreflective and nonflaking surface is also disclosed.

11 Claims, 4 Drawing Sheets

DARK METALLIC PRODUCT

This application is a continuation, of application Ser. No. 06/916,598, filed Oct. 8, 1986 now abandoned.

BACKGROUND AND SUMMARY OF THE INVENTION

This invention relates to a metallic product having a dark, nonreflective and nonflaking surface, and to a method of manufacturing the surface.

The metallic product(s) of this invention, that is, having a dark, nonreflective and nonflaking surface have nondecorative utility, for example as a surgical needle. A surgical needle having a dark and nonreflective surface is more visible at and around a wound site having a restrictive field of view, than a needle having a shiny and reflective stainless steel surface. That the dark and nonreflective surface of the needle must also be nonflaking is important, if not critical, so as not to introduce any foreign, extraneous, and possibly toxic substance into the wound.

The metallic product(s) having a dark, nonreflective and nonflaking surface may also be useful in diagnostic and analytical testing, for example where the absorption of an amount of light can be measured as a function of the increase in the temperature of the metallic product.

It is to be understood that the term "dark" in this specification is synonomous with the term "black", and further that the terms "dark", "black", "nonreflective" (or nonreflecting), and "nonflaking" in this specification have the same meaning as used in the prior art. Please see, e.g., a disclosure of black nickel plating in "Metals Handbook 8th Edition" vol. 2 pages 432 and 435, T. Lyman, Ed., Amer. Soc. For Metals, OH, U.S.A. 1964, which is incorporated herein by reference.

One embodiment of this invention is an improved metallic product manufactured from a non-300 series stainless steel. The improvement comprises the surface of the metallic product being dark and nonflaking.

Other embodiments of this invention are an improved metallic product having a dark surface and manufactured from a non-300 series stainless steel. One of the improvements comprises the dark surface of the metallic product being nonflaking. Another improvement comprises the dark surface of the metallic product being nonreflective and nonflaking.

In all of the above described improvements, the dark, nonreflective and nonflaking surface of the metallic product is nondecorative.

Specific embodiments to all of the improvements described above are wherein: the stainless steel is selected from or substantially equal to a member of the group consisting of martensitic and ferritic steels; the stainless steel is selected from or substantially equal to the 400 series; the stainless steel is selected from or substantially equal to types 420, 420F, 440 or 455; and the atomic composition of the metallic product surface does not essentially contain zinc.

A method of manufacturing a metallic product from a non-300 stainless steel, the surface of the metallic product being dark and nonflaking, has been invented. The method comprises:

(a) selecting the type of stainless steel and forming it into a product having the desired configuration;
(b) submersing the product into a liquid comprising a strong acid;

(c) substantially maintaining a constant temperature of the liquid while the product is submersed;
(d) maintaining the product in the constant temperature liquid for a sufficient period of time to make the surface dark; and
(e) removing the product from the constant temperature liquid.

In one embodiment, the method comprises the additional step of (f) neutralizing any residual and nonreacted acid remaining on the dark and nonflaking surface of the metallic product. In a specific embodiment, the neutralizing step comprises rinsing the dark and nonflaking surface of the metallic product with water; and drying the product.

In another embodiment, step (a) includes after forming the metallic product: removing any residual nonmetallic impurities remaining on the surface of the product. In still another embodiment, the temperature of the liquid in the substantially maintaining step is above ambient temperature.

Also, a method of manufacturing a metallic product from a stainless steel, the surface of the product being dark, nonreflective and nonflaking has been invented. The method comprises:

(a) selecting a stainless steel from, or substantially equal to a member of the group consisting of martensitic and ferritic steels, and forming the stainless steel selected into a product having the desired configuration;
(b) submersing the product into a solution comprising a strong acid and water, the anion of the acid being monovalent;
(c) substantially maintaining a constant temperature of the solution while the product is submersed;
(d) maintaining the product in the constant temperature solution for a sufficient period of time to make the surface dark and nonreflective; and
(e) removing the product from the constant temperature solution.

In one embodiment, the method comprises the additional step of (f) neutralizing any residual and nonreacted acid remaining on the dark, nonreflective and nonflaking surface of the metal product. In a specific embodiment, the neutralizing step comprises rinsing the dark, nonreflective and nonflaking surface of the metal product with water; and drying the product.

In another embodiment, step (a) includes after forming the metallic product: removing any residual impurities selected from the group consisting of greases, oils and mixtures thereof remaining on the surface of the product. In still another embodiment, the temperature of the solution in the substantially maintaining step is at about 180° F.±10° F.

Another method of manufacturing a metallic product from a stainless steel, the surface of the product being dark, nonreflective and nonflaking has been invented. The method comprises:

(a) selecting a stainless steel from, or substantially equal to a member of the group consisting of the 400 series, and forming the stainless steel selected into a product having the desired configuration;
(b) submersing the needle into a solution of nitric acid and water;
(c) substantially maintaining a constant temperature of about 180°±10° F. of the solution while the product is submersed;
(d) maintaining the product in the constant temperature solution for up to about 40 minutes;

(e) removing the product from the constant temperature solution; and (f) neutralizing any residual and nonreacted acid remaining on the dark, nonreflective and nonflaking surface of the product.

In one embodiment, the solution in the submersing step comprises about 50 percent by weight of nitric acid.

In another embodiment, the neutralizing step comprises: submersing the metallic product in a dilute base; first removing the product from the base; and second removing any residual and nonreacted base remaining on the dark, nonreflective and nonflaking surface of the product. In a specific embodiment, the base is ammonium hydroxide.

In a further embodiment, the second removing substep of step (f) comprises rinsing the dark, nonreflective and nonflaking surface of the metallic product with a drying agent; and drying said product. In a specific embodiment, the drying agent is ethanol.

In yet a further embodiment, step (a) includes after forming the metallic product: removing any residual impurities selected from the group consisting of greases, oils and mixtures thereof remaining on the surface of the product.

DESCRIPTION OF THE PREFERRED EMBODIMENT(S)

Figure 1:
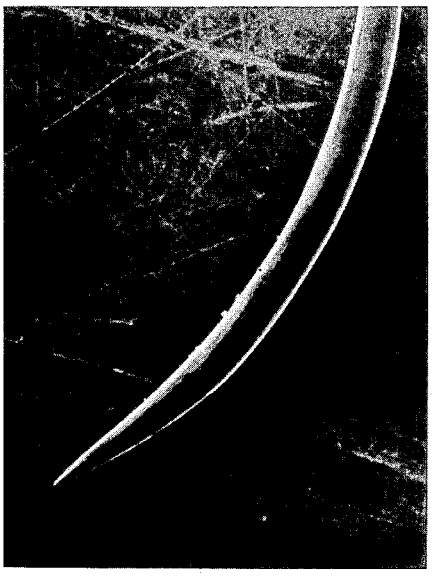
FIGS. 1 and 4 are microphotographs of two different dark, nonreflective and nonflaking metallic needles at 20 times magnification.
Figure 2:
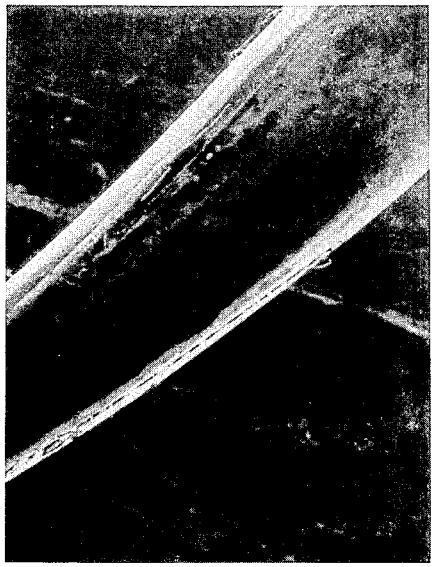
FIGS. 2 and 5 are microphotographs of the needles of FIGS. 1 and 3, respectively, at 100 times magnification.
Figure 3:
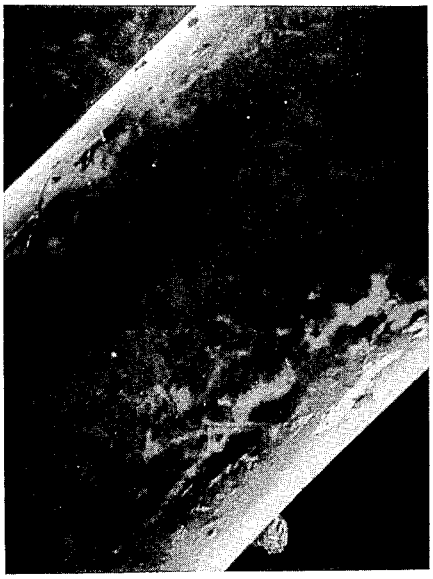
FIGS. 3 and 6 are microphotographs of the needles of FIGS. 1 and 3, respectively, at 200 times magnification.

FIGS. 1 to 3 are microphotographs showing a dark, nonreflective and nonflaking surface of a metallic surgical needle. The microphotographs of FIGS. 1 to 3 have been taken at 20, 100, and 200 magnification, respectively.

Figure 4:
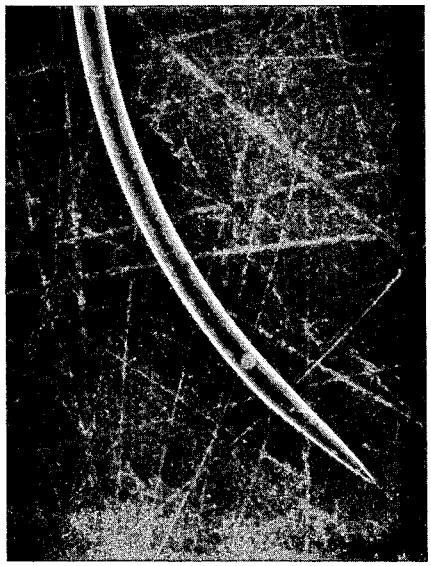
Figure 5:
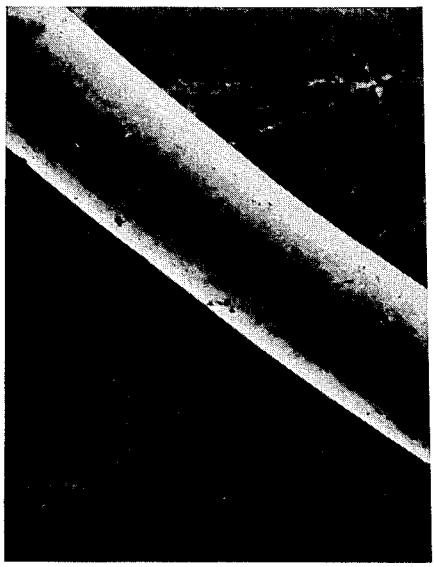
Figure 6:
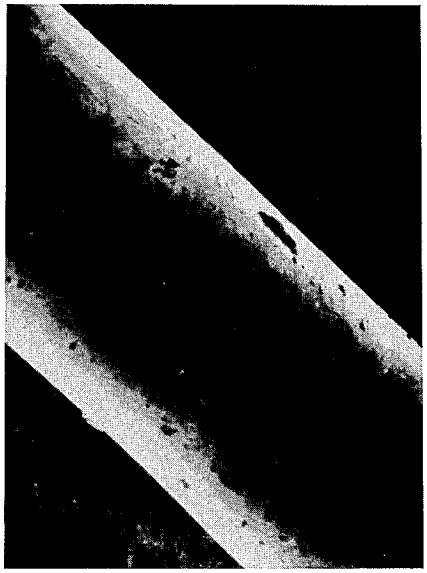

FIGS. 4 to 6 are microphotographs showing a dark, nonreflective and nonflaking surface of a different (from the needle of FIGS. 1 to 3) metallic surgical needle. As in FIGS. 1 to 3, the microphotographs of FIGS. 4 to 6 have been taken at 20, 100, and 200 magnification, respectively.

Figure 7:
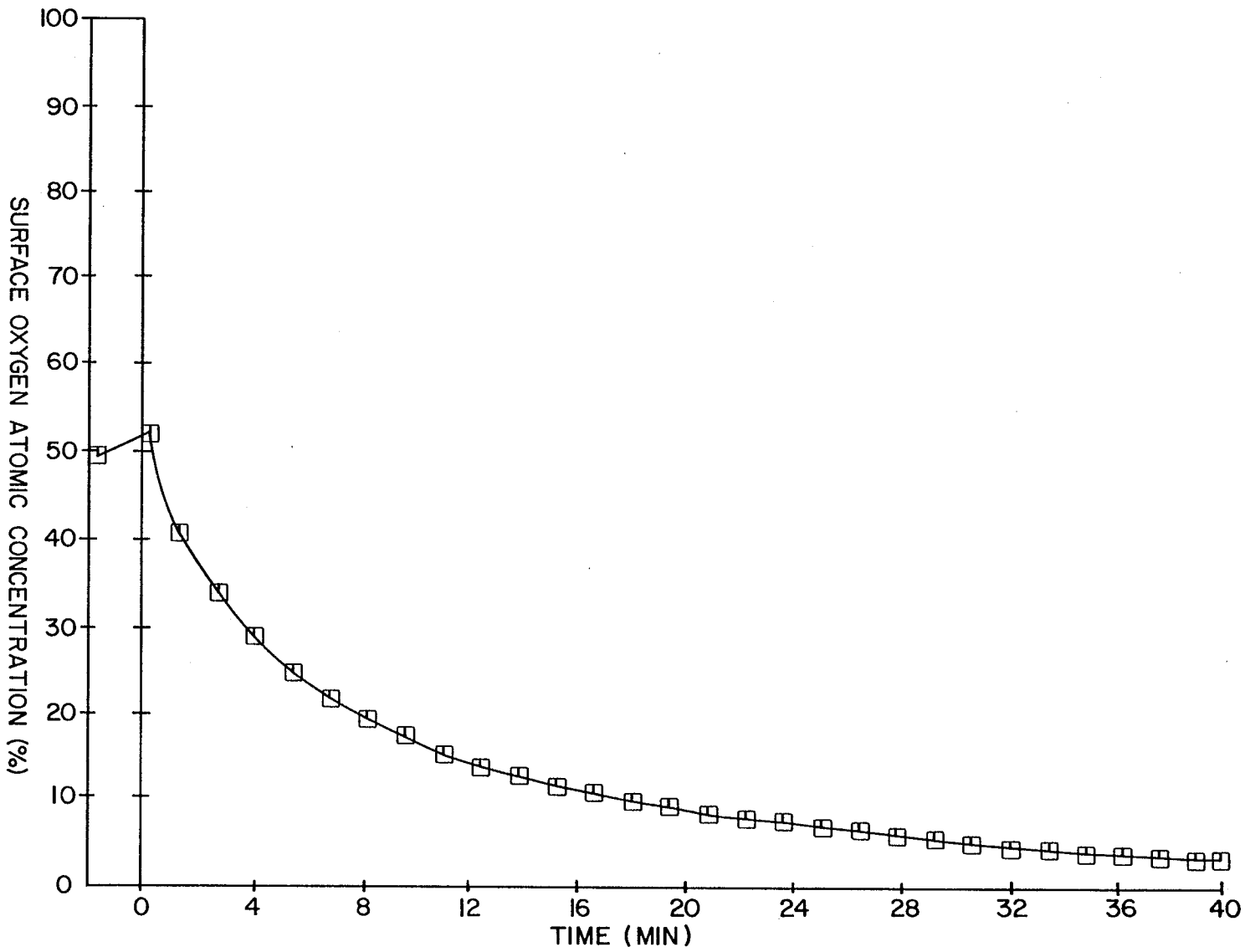
FIG. 7 is a graph showing the atomic oxygen content at the surface of a dark metallic product of this invention.

FIG. 7 is a graph of the atomic oxygen content at the surface of a dark, nonreflective and nonflaking metallic product of this invention. The oxygen content is plotted against time (in minutes).

The curve of FIG. 7 shows a smooth transition of the oxygen concentration over the time interval. That is, the smooth shape of the curve seems to suggest that the dark, nonreflective and nonflaking properties are even over the entire surface of the metallic product.

Surgical needles identical or similar to those shown in FIGS. 1 to 7 were submitted for toxicological review. With the submission, prior obtained information was provided indicating that the tissue penetration of surgical needles having a dark, nonreflective and nonflaking surface is essentially identical to a stainless steel surgical needle having a shiny and reflective surface; and that nothing comes off the dark and nonreflective surface (of the needles) when they are rubbed. Based on this prior information, and on an examination of electron microphotographs (similar or identical to those shown in FIGS. 1 to 6), a judgement was made that no toxicological evaluation of the surgical needles had to be conducted.

A solution is prepared containing about 50 percent nitric acid and 50 percent water. Tap water is satisfactory, although distilled water can also be used. The volume of the 50 percent nitric acid solution is not critical to the practice of the invention provided there is sufficient volume for the stainless steel product(s) to be totally immersed in the solution.

The container holding the 50 percent nitric acid and water solution is heated to and maintained at a temperature of 180° F.±10° F. The variance in the temperature (from 180° F.) is dependent on the boiling point of the nitric acid solution, the precision of the thermostat regulating the temperature, and the rate of reaction of the 50 percent nitric acid with the stainless steel product(s).

A metallic product manufactured from a material essentially identical to a type 420 or 420F martensitic stainless steel is immersed in the 50 percent nitric acid and water solution. The metallic product is maintained in the 50 percent nitric acid and water solution until it turns dark.

The amount of time needed to turn the metallic product dark and nonreflective can be ascertained by the person skilled in the art without undue experimentation, and is not critical to the practice of this invention. Under many circumstances, a length of time of about 15 to 30 minutes can be considered normal. However, other times, for example from about 15 to 20 minutes, or up to about 40 minutes can also be used to adequately obtain a metallic product having a dark surface.

The metallic product is then removed from the nitric acid and water solution, and rinsed with water. Again, tap water can be used. Distilled water can also be used. Preferably, after rinsing any nitric acid remaining on the surface of the dark, nonreflective and nonflaking metallic product, it is neutralized by dipping it into a container holding dilute ammonium hydroxide.

If the preferred neutralizing step described above is carried out, the metallic product having a dark, nonreflective and nonflaking surface is rinsed again in tap water. The temperature of the tap water is about 100° F. to 150° F. The metallic product is then further rinsed with ethyl alcohol (as a drying agent) to remove any residual water remaining on the surface from the second water rinse.

It is important to note that ethyl alcohol is disclosed as the drying agent (for removing any residual water). However, ethyl alcohol is not critical to the practice of this invention. That is, any drying agent can be used provided it effectively removes the remaining residual water from the surface of the metallic product, and then evaporates off the surface or is nontoxic to living tissue.

The metallic product is then dried by any means known in the art, for example air drying-impressive. The resulting metallic product has a dark nonreflective and nonflaking surface.

We claim:

1. A method of manufacturing a metallic product from a non-300 series stainless steel, the surface of the metallic product being dark and nonflaking, comprising:

(a) selecting a stainless steel and forming it into a product having the desired configuration;
(b) submersing the product into a solution of about 50 percent nitric acid and water;
(c) substantially maintaining a constant temperature of between 180° F. to 190° F. of the solution while said product is submersed;
(d) maintaining said product in the constant temperature solution for a sufficient period of time to make the surface dark; and
(e) removing said product from said constant temperature solution.

2. A method of claim 1 comprising the additional step of (f) neutralizing any residual and nonreacted acid remaining on the dark and nonflaking surface of the metallic product.

3. A method of claim 2 wherein the neutralizing step comprises rinsing the dark and nonflaking surface of the metallic product with water; and drying said product.

4. A method of claim 1 wherein step (a) includes after forming the metallic product: removing any residual nonmetallic impurities remaining on the surface of the product.

5. A method of manufacturing a metallic product from a stainless steel, the surface of the metallic product being dark, nonreflective and nonflaking, comprising:
(a) selecting a stainless steel from, the 400 series, and forming the stainless steel selected into a product having the desired configuration;
(b) submersing the product into a solution of nitric acid and water;
(c) substantially maintaining a constant temperature of between 180° F. to 190° F. of the nitric acid and water solution while said product is submersed;
(d) maintaining said product in the constant temperature solution for up to about 40 minutes;
(e) removing said product from said constant temperature solution; and
(f) neutralizing any residual and nonreacted acid remaining on the dark, nonreflective and nonflaking surface of the product.

6. A method of claim 5 wherein the solution in the submersing step comprises about 50 percent by weight of nitric acid.

7. A method of claim 5 wherein the neutralizing step comprises submersing the metallic product in a dilute base; first removing the product from the base; and second removing any residual and nonreacted base remaining on the dark, nonreflective and nonflaking surface of the product.

8. A method of claim 7 wherein the base is ammonium hydroxide.

9. A method of claim 7 wherein the second removing substep of step (f) comprises rinsing the dark, nonreflective and nonflaking surface of the metallic product with a drying agent; and drying said product.

10. A method of claim 9 wherein the drying agent is ethanol.

11. A method of claim 9 wherein step (a) includes after forming the metallic product: removing any residual impurities selected from the group consisting of greases, oils and mixtures thereof remaining on the surface of the product.

* * * * *